US007575071B2

(12) United States Patent
Schauerte

(10) Patent No.: US 7,575,071 B2
(45) Date of Patent: Aug. 18, 2009

(54) CONTINUOUS MIXING SYSTEM

(75) Inventor: Manfred Schauerte, Schmallenberg (DE)

(73) Assignee: Tracto-Technik Paul Schmidt Spezialmaschinen (DE)

( * ) Notice: Subject to any disclaimer, the term of this patent is extended or adjusted under 35 U.S.C. 154(b) by 0 days.

(21) Appl. No.: 11/859,510

(22) Filed: Sep. 21, 2007

(65) Prior Publication Data

US 2008/0041449 A1 Feb. 21, 2008

Related U.S. Application Data

(63) Continuation of application No. 10/134,817, filed on Apr. 29, 2002, now abandoned, which is a continuation of application No. 09/415,817, filed on Oct. 12, 1999, now abandoned.

(30) Foreign Application Priority Data

Oct. 14, 1998 (DE) ..... 298 18 289 U
Apr. 24, 1999 (DE) ..... 199 18 775

(51) Int. Cl.
*B01F 5/06* (2006.01)

(52) U.S. Cl. ..... 175/62; 175/206; 175/217; 366/182.2; 366/336

(58) Field of Classification Search ..... 366/152.6, 366/153.1, 163.1, 163.2, 174.1, 175.2, 152.2, 366/336, 182.2, 182.4; 175/62, 206, 217
See application file for complete search history.

(56) References Cited

U.S. PATENT DOCUMENTS

| | | | | |
|---|---|---|---|---|
| 2,453,465 A | | 11/1948 | Sloan | 366/136 |
| 2,631,017 A | | 3/1953 | Gibson et al. | 366/330.1 |
| 3,115,195 A | | 12/1963 | Graham et al. | 175/17 |
| 3,591,147 A | | 7/1971 | Anderson et al. | 366/14 |
| 3,691,070 A | | 9/1972 | Pippen | 507/100 |
| 3,782,695 A | | 1/1974 | Sandiford | 366/163.1 |
| 3,791,255 A | * | 2/1974 | Fox et al. | 86/20.15 |
| 3,843,099 A | | 10/1974 | Duncan | 366/76.2 |
| 3,893,655 A | | 7/1975 | Sandiford | 366/131 |
| 4,051,065 A | | 9/1977 | Venema | 366/181.5 |
| 4,210,166 A | | 7/1980 | Munie | 137/271 |
| 4,444,277 A | | 4/1984 | Lewis | 175/66 |
| 4,664,528 A | | 5/1987 | Rodgers et al. | 366/142 |
| 4,812,047 A | | 3/1989 | Baumann | 366/141 |
| 5,213,414 A | | 5/1993 | Richard et al. | 366/27 |
| 5,344,619 A | | 9/1994 | Larwick et al. | 422/261 |
| 5,413,184 A | | 5/1995 | Landers | 175/62 |
| 5,720,551 A | | 2/1998 | Shechter | 366/147 |
| 5,779,355 A | | 7/1998 | Pullman | 366/137 |
| 5,934,390 A | | 8/1999 | Uthe | 175/67 |
| 6,152,356 A | | 11/2000 | Minden | 299/17 |

FOREIGN PATENT DOCUMENTS

DE 42 17 373 12/1993

OTHER PUBLICATIONS

European Search Report (Europaischer Recherchenbericht) from European Patent Office dated Dec. 19, 2001 listing prior art patent documents.

* cited by examiner

*Primary Examiner*—David L Sorkin

(57) ABSTRACT

The invention relates to a mixing system for the preparation of a drilling fluid for horizontal drilling methods, having a high-pressure pump and a feed line for the additive medium arranged upstream of the high-pressure pump in the direction of flow.

14 Claims, 3 Drawing Sheets

CONTINUOUS MIXING SYSTEM

Figure 1:
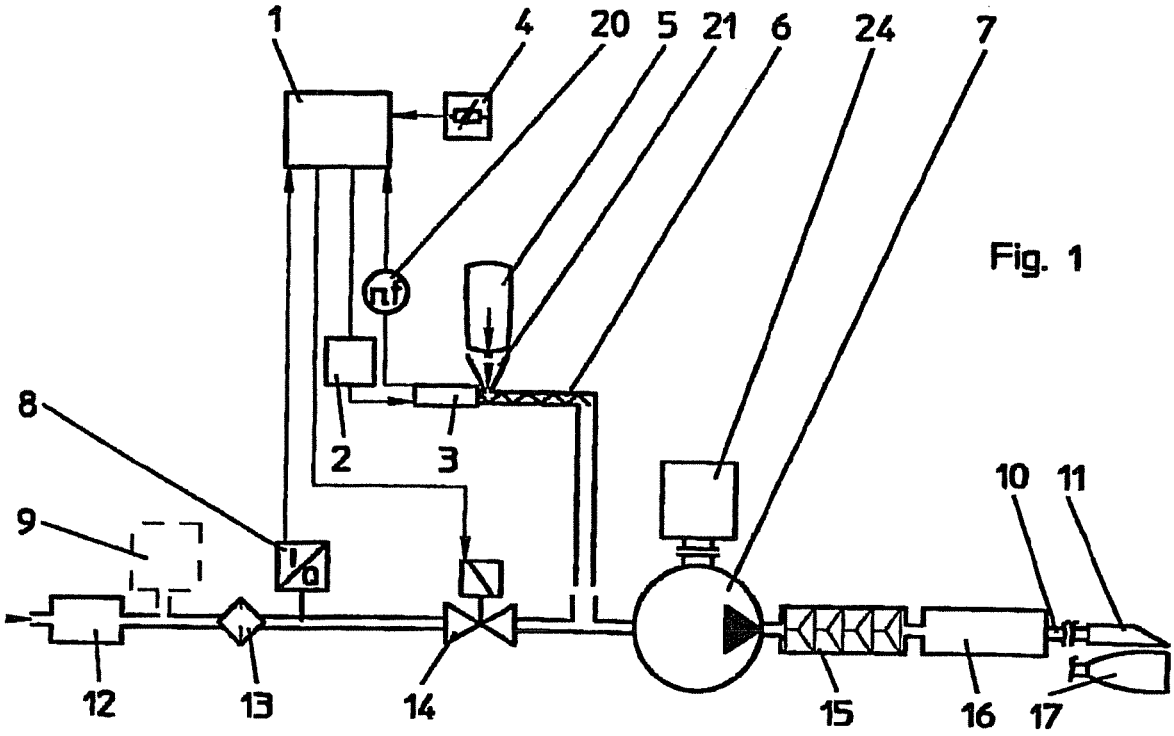

This application is a continuation of application Ser. No. 10/134,817, filed on Apr. 29, 2002, now abandoned which is a continuation of application Ser. No. 09/415,817, filed on Oct. 12, 1999, now abandoned which claims foreign priority to German Application Nos. 298 18 289 filed Oct. 14, 1998, and 199 18 775.4 filed Apr. 24, 1999, all of which are hereby incorporated by reference.

The invention relates to a mixing system as used for the preparatory mixing of a drilling fluid for horizontal drilling.

In horizontal drilling, with the aid of drilling or flushing liquids which are fed to the drill and, for example, emerge in the region of the drill head and are thus passed into the drilled hole, the drilling operation is improved and facilitated in that the soil is softened and the drillings are removed.

It has become established practice to use a suspension of bentonite in water, which is used in different consistencies, depending on the existing soil conditions. Such a suspension has the property of retaining the drillings in suspension so as to be able to remove them from the drilled hole, and also has the advantage, when a new pipe run is drawn in, that the latter is lubricated and, after having been drawn in and after a certain amount of time for hardening, is protected from the surrounding soil. To vary the properties of the suspension, it is known to admix polymers and other substances, for example soda ash, in order to adjust the pH.

Known mixing systems operate by the principle that the desired quantity of drilling fluid is preparatorily mixed in a storage tank whose content is then available for the drilling operation. Such mixing systems are known as batch mixers, since one batch can be made available for drilling in each mixing operation.

After the drilling fluid has been used up, the storage tank is replenished by the preparatory mixing of a new batch. As the practical effect of this is to cause disruptive delays in drilling, it is customary to provide a second storage tank, so that the liquid batches can be mixed in one tank while the other tank supplies the drill. The disadvantage of such systems resides in an increased space requirement and additional costs. Another disadvantage of the known batch mixers resides in the fact that the necessary mixing pumps must be especially durable because of the aggressive nature of an abrasive medium like bentonite. This results either in increased costs or in increased wear.

Furthermore, the necessary quantity of drilling suspension cannot generally be accurately estimated, so that the drilling fluid is often not completely used up after the end of the drilling operation and has to be disposed of. If the drilling fluid is left in the tank, subsequent swelling of the drilling fluid may occur. Because of the increased viscosity, problems may arise during drilling when this drilling fluid is once again used. In the winter, moreover, it is impossible to rule out frost damage to equipment by a drilling fluid that has not been completely used up.

The drilling fluid is generally fed to the drill by a high-pressure pump. Such pumps are not generally self-priming pumps. However, since the drilling fluid quite often has to be pumped at very high viscosity, the use of a self-priming supercharge pump is necessary to charge the high-pressure pump on the suction side. The use of such a supercharge pump also results in a substantial increase in cost.

The object of the invention is therefore to permit a simplified charging of a drilling system with a drilling fluid.

The object is achieved by the subject of the independent claims. Advantageous embodiments will be found in the subclaims. The achievement of the object is based on the principle of introducing additives, such as the pulverulent bentonite, upstream or downstream of the high-pressure pump.

In the case of a feed upstream of the high-pressure pump, service water is fed to the pump via a hydrant, a feed line for the additive medium being provided between hydrant and high-pressure pump. The feeding-in of the additive medium may be mechanically assisted and regulated with reference to various parameters. The same applies to the addition of supplementary additives such as, for example, polymers or soda ash.

After the additive medium has been fed in, it passes with the service water into the high-pressure pump, where intensive mixing takes place. In addition, a mixing section for further mixing may be provided downstream of the high-pressure pump. A swelling section may also adjoin the mixing section if a particular duration of swelling is desirable.

When the additive medium is introduced downstream of the high-pressure pump in the direction of flow, it is introduced in the region of the high-pressure jet of the high-pressure pump, which results in intensive mixing of the additive medium with the service water. The feed-in section may also be adjoined by additional mixing and swelling sections.

The mixing system according to the invention allows continuous, in other words on-line, mixing of the additives for the drilling fluid with the service water. Additional storage tanks are thus avoided, so that the mixing system is of exceptionally small dimensions and can be used directly adjacent to the drill. Because of its small size, the mixing system may be designed as integral parts of mobile drills.

Furthermore, during drilling, only that quantity of liquid which is directly consumed is mixed. Unused residual quantities of drilling fluid after drilling are avoided by the mixing system according to the invention.

Furthermore, minimal expenditure of material is achieved, since in addition to storage tanks mixing, circulating or supercharge pumps are also avoided. This is even possible in the case of non-aspirating high-pressure pumps, in that the liquid introduced on the suction side is, according to the invention, of low viscosity since it comprises either pure service water (fed in downstream of the high-pressure pump) or service water with bentonite that has not yet swelled (fed in upstream of the high-pressure pump).

A further advantage lies in the simplified possibility of reusing prepared drilling fluid. The large quantities of liquid which are frequently used in horizontal drilling have meant that "recycling" of the drilling fluid is necessary for both economic and ecological reasons. With the mixing system according to the invention, the viscosity of the reprocessed drilling fluid can be optimized for the new drilling operation by a preselected ratio of added water to admixed additive medium.

The compact construction achieved by means of the invention makes it possible to connect the mixing system to mobile drills of any desired size, as a high degree of variability exists regarding the possible quantity admixed and the mixing performance. The mixing system then merely needs to be connected to a hydrant on the construction site, the desired quantity of drilling fluid being available for the drilling operation in any combination of circumstances. The storage container preferably used for the additives to the mixing system is a silo or a so-called "big bag". The batch tanks otherwise customary, which can be of substantial dimensions for larger drilling systems, are unnecessary.

For structural reasons, the mixing system according to the invention has a lower energy consumption and longer service life than conventional units, not least because of the elimination of the additional pumps needed in the prior art.

With an automated mixing process, which can be achieved with the mixing system according to the invention, fully automatic running of the drilling operation is possible, as far as the drilling fluid is concerned, and can be supplemented by automation of the reprocessing system.

With the example of embodiment comprising addition of the additive medium on the pressure side, it is merely necessary to feed the service water to the high-pressure pump. This can be done either via a hydrant by the high-pressure pump itself or by a conventional water pump. The high-pressure pump itself does not need to be resistant to abrasive media.

The invention is explained in detail below with reference to the examples of embodiment shown in the drawing.

Figure 2:
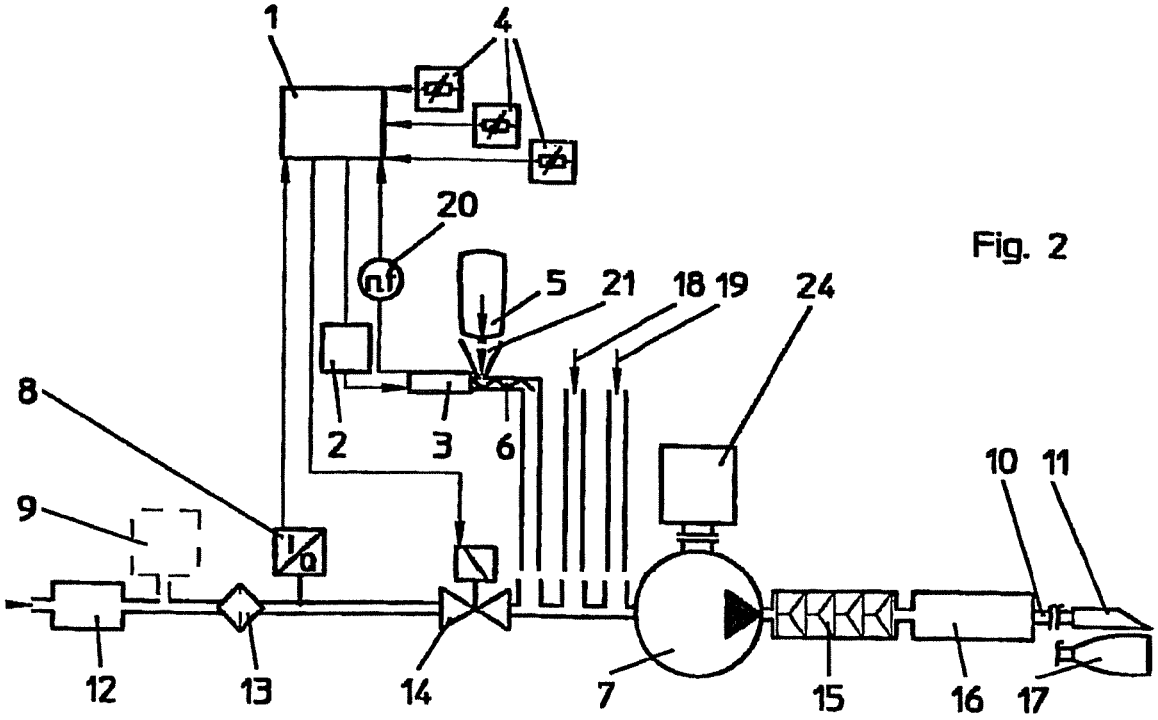
Figure 3:
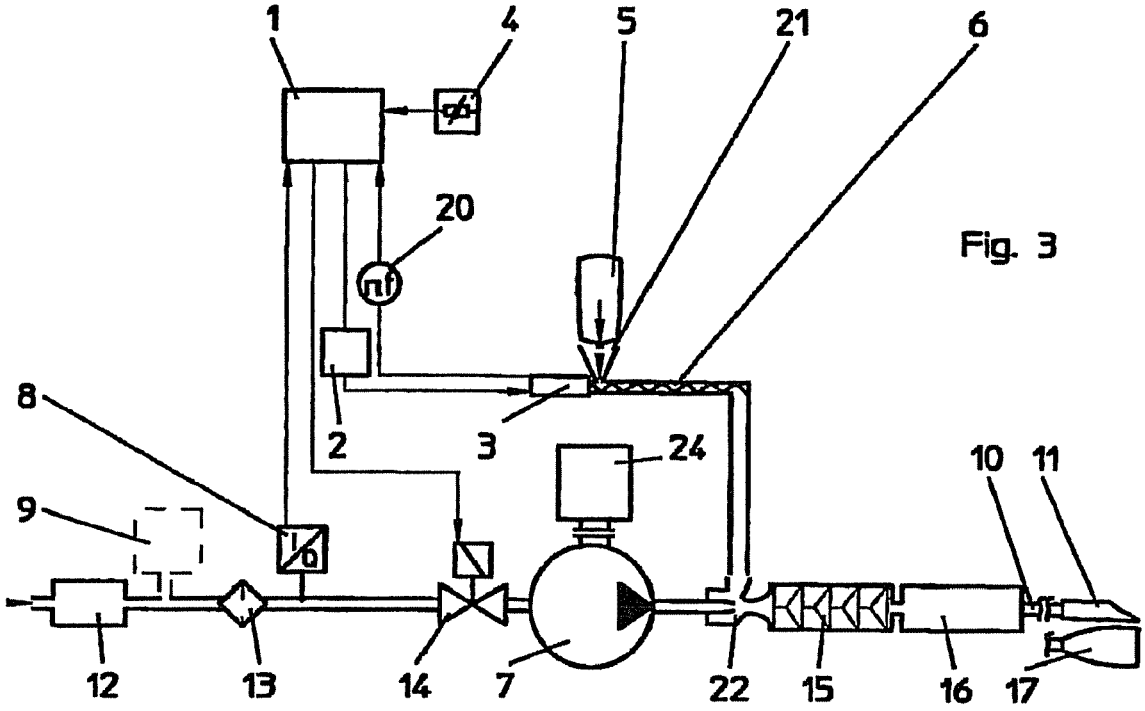
Figure 4:
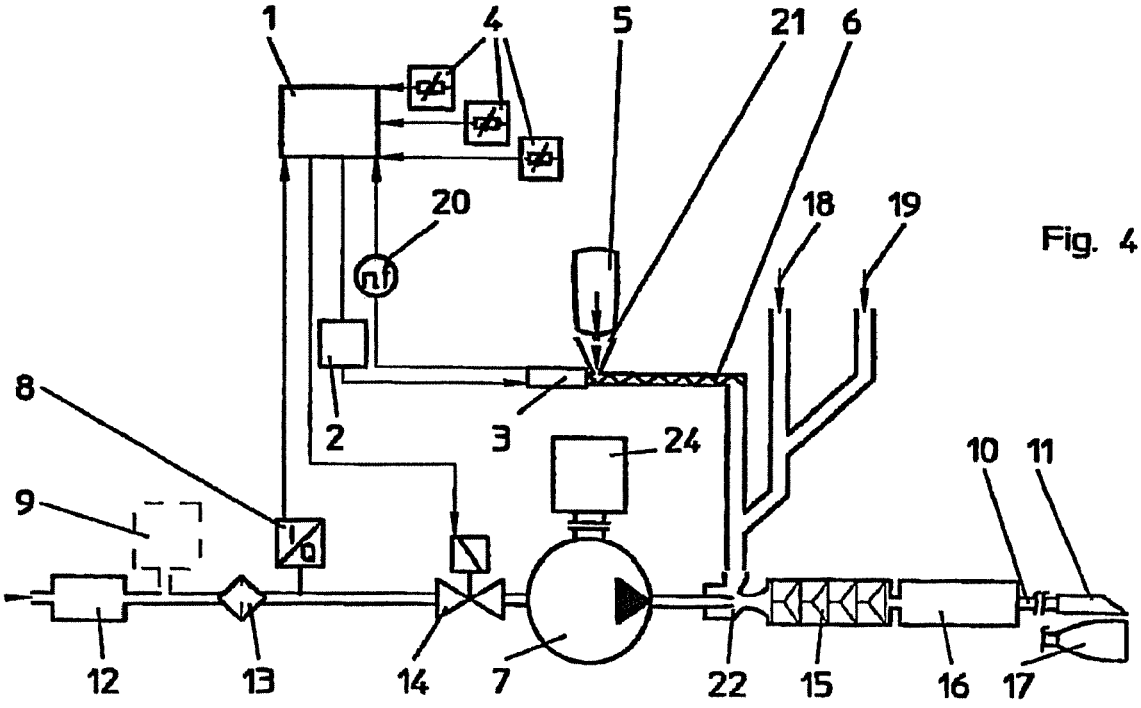

In the drawing:

FIG. 1 shows a mixing system according to the invention with the suspension medium being fed in upstream of the high-pressure pump in the direction of flow, FIG. 2 hows the mixing system according to FIG. 1 with feed lines for additives, FIG. 3 shows the mixing system according to FIG. 1 with a feed line for the additive medium downstream of the high-pressure pump, FIG. 4 shows the mixing system according to FIG. 3 with a feed line for additives.

Figure 5:
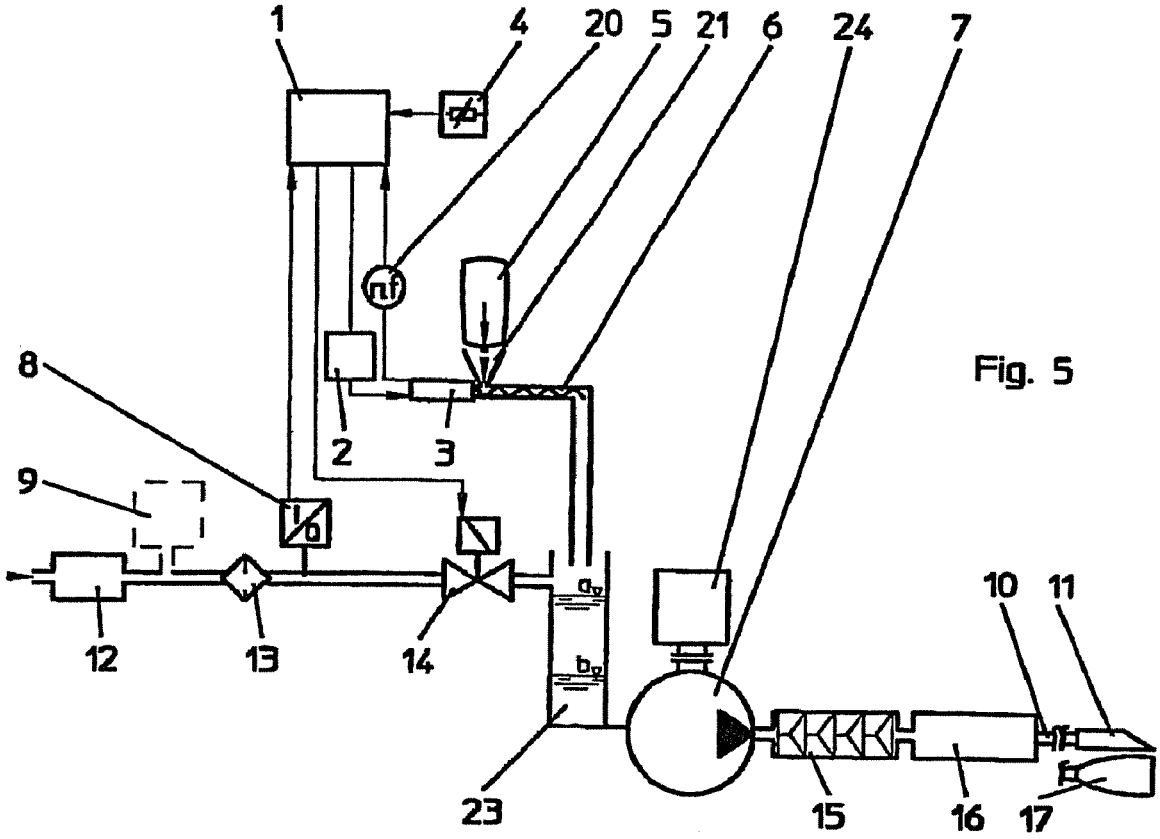
Figure 6:
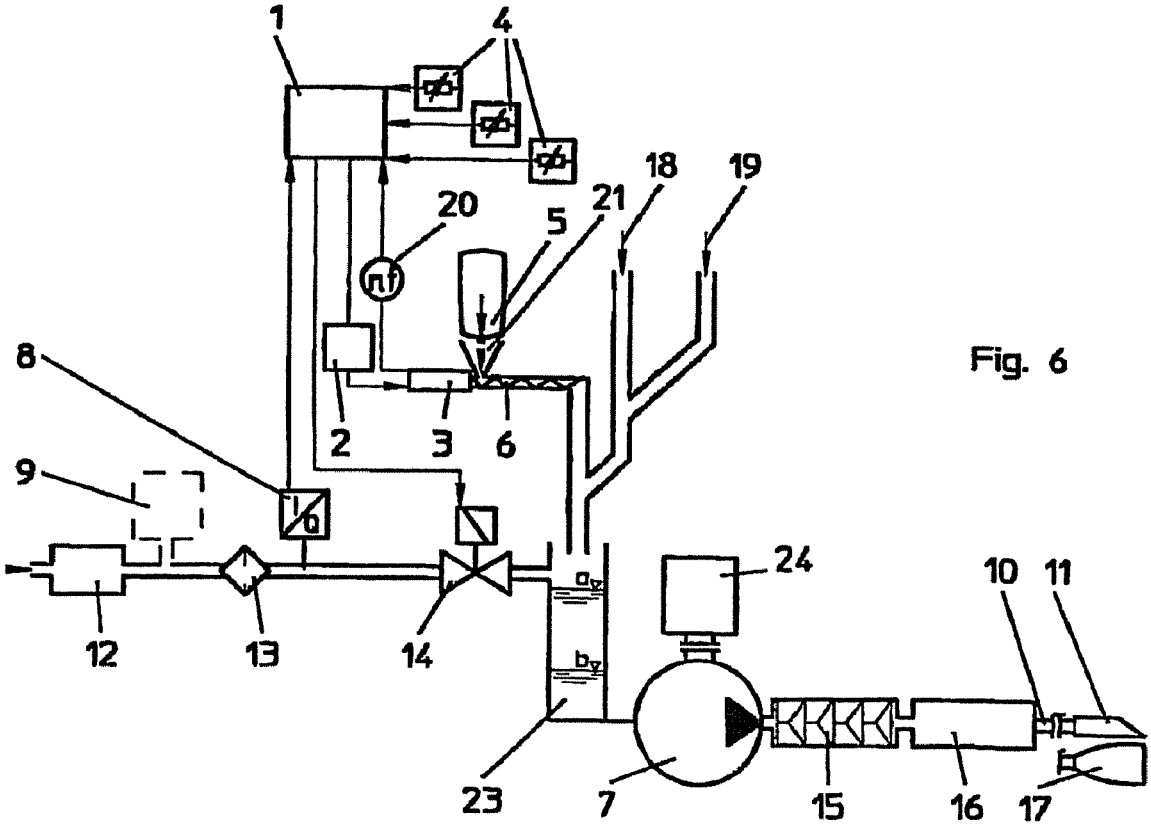

FIG. 5 shows the mixing system according to FIG. 1 with a buffer pipe and level adjustment, and FIG. 6 shows the mixing system according to FIG. 5 with an additional feed line for additives.

According to a first embodiment of the invention, the suspension medium is fed to the service water upstream of the high-pressure pump (FIGS. 1, 2, 5, 6).

The service water is fed to the mixing system according to this embodiment on the low-pressure side of a high-pressure pump, via a hydrant. On the low-pressure side, the mixing system also has a pressure-reducing valve 12, via which the service water is fed to the high-pressure pump 7 via a filter member 13 and a shut-off valve 14. With the aid of the shut-off valve 14, the service water feed can be turned on and off, and adjusted in accordance with certain parameters on the basis of control commands from a system of control electronics 1 connected to the valve 14. The system of control electronics 1 is connected to a sensor 8 which measures the volume of water actually passing through, which is determined by the head of the high-pressure pump 7 with adjustable drive 24, which can be set manually (e.g. via a potentiometer) or adjusted automatically.

With the aid of the setting members 4, particular target values can be preset in order to achieve a desired mixing ratio, the individual parameters being determined by the system of control electronics 1.

The quantity of additive medium necessary for the desired mixing ratio (bentonite as a quantity in suspension) is fed in via a conveying device 6 which is connected to a so-called big bag 5 or other storage containers containing the bentonite stock, precise metering taking place via a drive 3 of the conveying device 6 which is connected via a setting member 2 to the system of control electronics 1.

In this arrangement, bentonite passes via a feed line 21 into the conveying device 6, which conveys it to the high-pressure pump 7 in a quantity dependent on the speed of the drive 3, the speed of revolution of the drive being transmitted to the system of control electronics 1 via a sensor 20. With the aid of a variance comparison, the system of control electronics 1 guarantees, via the setting member 2, that the desired speed of rotation of the drive 3 is maintained. The suspension medium passes downstream of the shut-off valve 14 on the low-pressure side of the high-pressure pump 7 into the service water and is conveyed together therewith by the high-pressure pump 7 into a high-pressure mixing section 15, intensive mixing already taking place as a result of the pumping operation of the high-pressure pump 7. The mixing section 15 comprises a plurality of static or dynamic mixers operated in series or parallel, static mixers being preferred, as in these only the components to be mixed are moved. The mixing is intensified by division, deflection and reforming of the media. In this process, the spherical structure of the bentonite constituents is broken up by the high shear forces acting in the mixer. This results in a reduction of the swelling time, as the surface of the suspension medium at which the water molecules accumulate is increased.

Provided adjacent to the mixing section 15 is a swelling section 16 which, depending on the embodiment, allows a longer or shorter swelling period of the drilling suspension. The swelling section 16 may consist of an intermediate container or a coiled tube, or may also take the form of the section of the drilling pipe 10 via which the suspension is fed to the drilling head 11 or the expansion tool 17.

Further additives, such as for example polymers or soda ash, may be added to the drilling suspension via the feed lines 18, 19, which are again fed in immediately upstream of the high-pressure pump 7.

If the water supply is inadequate or non-existent, the service water may also be fed in via a storage tank 9.

In the preferred embodiment shown in FIGS. 5 and 6, the suspension medium passes into the service water in a buffer container 23. The buffer container possesses a level switch (a, b) which switches the bentonite feed on and off, depending on whether the medium is above the upper mark a or below the lower mark b. The buffer container 23 preferably takes the form of a narrow, vertically arranged pipe which prevents demixing of the service water/drilling suspension mixture before entry into the pump 7. The buffer container 23 further prevents the unintentional introduction of air into the high-pressure pump 7.

In another embodiment of the invention (see FIGS. 3 and 4), the suspension medium is fed in on the high-pressure side of the high-pressure pump 7. With this arrangement, the suspension medium passes into the service water in the region of the water jet nozzle 22 of the high-pressure pump, as a result of which intensive mixing is achieved. The mixing situation can be influenced via the design of the water jet nozzle 22. Preferably, the diameter of the water jet nozzle can be adjusted according to the flow volume, in order to ensure an intensive water jet at all times.

The invention claimed is:

1. A method for continuously supplying drilling fluid suspension comprising water and a drilling fluid additive medium to a horizontal drill head, said method comprising:

providing a continuous stream of water;

providing a drilling fluid additive medium;

introducing said additive medium to said stream of water at a selected location to form a drilling fluid suspension stream;

providing a high pressure pump in the vicinity of said selected location;

pressurizing said water stream or drilling fluid suspension stream in the vicinity of said selected location by flowing such stream through said high pressure pump to enhance mixing of additive medium and water and to provide a pressurized drilling fluid suspension stream for conveyance to a drill head;

conveying said pressurized drilling fluid suspension stream under the force of the high pressure pump through a static mixing chamber;

conveying said pressurized drilling fluid suspension stream under the force of the high pressure pump through a swelling section downstream of said pump, said swelling section having a length or width sufficient to allow swelling of the suspension stream; and conveying said pressurized drilling fluid suspension stream under the force of the high pressure pump to a horizontal drill head.

2. The method of claim 1 in which said high pressure pump is located downstream of said selected location and said pressurizing occurs downstream of said selected location and said pressurizing includes pressurizing of the drilling fluid suspension stream.

3. The method of claim 1 in which said high pressure pump is located upstream of said selected location and further comprising the step of:

providing a water jet nozzle in the vicinity of said selected location, said water jet being in direct fluid communication with the high pressure pump.

4. The method of claim 3 further comprising the step of:

adjusting the flow volume through said water jet nozzle by changing the diameter of said nozzle.

5. The method of claim 1 further comprising the step of:

providing a storage container containing said additive medium.

6. The method claim of claim 5 further comprising the steps of:

providing a conveying device, whereby said conveying device introduces said additive medium to said stream of water at said selected location;

providing control electronics and at least one sensor;

measuring a value via said sensor; and adjusting the speed of said conveying device via said control electronics based on said value obtained by the sensor.

7. A method for continuously supplying drilling fluid suspension comprising water and a drilling fluid additive medium to a horizontal drill head, said method comprising:

providing a continuous stream of water;

providing a drilling fluid additive medium;

introducing said additive medium to said stream of water at a selected location to form a drilling fluid suspension stream;

providing a high pressure pump in the vicinity of said selected location;

pressurizing said water stream or drilling fluid suspension in the vicinity of said selected location by flowing such stream through said high pressure pump to enhance mixing of additive medium and water and to provide a pressurized drilling fluid suspension stream for conveyance to a drill head;

conveying said pressurized drilling fluid suspension stream under the force of the high pressure pump through a static mixing chamber; and conveying said pressurized drilling fluid suspension stream under the force of the high pressure pump to a horizontal drill head.

8. The method of claim 7 in which said high pressure pump is located down stream of said selected location and said pressurizing occurs downstream of said selected location and said pressurizing includes pressurizing of the drilling fluid suspension stream.

9. The method of claim 7 in which said high pressure pump is located upstream of said selected location and further comprising the step of:

providing a water jet nozzle in the vicinity of said selected location, said water jet being in direct fluid communication with the high pressure pump.

10. The method of claim 9 further comprising the step of:

adjusting the diameter of said water jet nozzle.

11. The method of claim 9 in which said high pressure pump is located downstream of said selected location and pressurizing occurs downstream of said selected location and said pressurizing includes pressurizing of the drilling fluid suspension stream.

12. The method of claim 7 further comprising the step of:

providing a storage container, said storage container containing said additive medium.

13. The method of claim 12 further comprising the steps of:

providing a conveying device, whereby said conveying device introduces said additive medium to said stream of water at said selected location;

providing control electronics and at least one sensor;

measuring a value via said sensor; and adjusting the speed of said conveying device via said control electronics based on said value obtained by said sensor.

14. A method for continuously supplying drilling fluid suspension comprising water and a drilling fluid additive medium to a horizontal drill head, said method comprising:

providing a continuous stream of water;

providing a drilling fluid additive medium;

introducing said additive medium to said stream of water at a selected location to form a drilling fluid suspension stream;

providing a high pressure pump downstream of said selected location;

pressurizing said drilling fluid suspension stream in the vicinity of said selected location by flowing such stream through said high pressure pump producing a pressure sufficient to feed a horizontal drill head via a drill string, said high pressure pump enhancing mixing of additive medium and water such that said high pressure pump provides a pressurized drilling fluid suspension stream through the drill string to the drill head;

conveying said pressurized drilling fluid suspension stream under the force of the high pressure pump through a static mixing chamber; and continuously conveying said pressurized drilling fluid suspension stream under the force of the high pressure pump to a horizontal drill head.

* * * * *